US007992578B2

(12) United States Patent
Tobias et al.

(10) Patent No.: US 7,992,578 B2
(45) Date of Patent: Aug. 9, 2011

(54) HAIR TREATMENT DEVICE

(76) Inventors: Andrew J Tobias, Pacific Palisades, CA (US); Keith Harris, Studio City, CA (US)

( * ) Notice: Subject to any disclaimer, the term of this patent is extended or adjusted under 35 U.S.C. 154(b) by 502 days.

(21) Appl. No.: 11/646,901

(22) Filed: Dec. 28, 2006

(65) Prior Publication Data

US 2007/0193601 A1 Aug. 23, 2007

Related U.S. Application Data

(60) Provisional application No. 60/755,580, filed on Dec. 30, 2005.

(51) Int. Cl.
*A45D 2/40* (2006.01)

(52) U.S. Cl. ..... 132/225; 132/211

(58) Field of Classification Search ..... 132/223–227, 132/229–231; 219/222, 225, 227
See application file for complete search history.

(56) References Cited

U.S. PATENT DOCUMENTS

| | | | | |
|---|---|---|---|---|
| 3,603,765 | A | 9/1971 | Underwood | |
| 4,870,250 | A | 9/1989 | Rizzuto | |
| 4,939,340 | A * | 7/1990 | Brill | 219/225 |
| 5,120,933 | A | 6/1992 | Altamore | |
| 5,934,293 | A * | 8/1999 | Kaizuka | 132/225 |
| 6,070,596 | A * | 6/2000 | Altamore | 132/224 |
| 6,119,702 | A | 9/2000 | Habibi | |
| 6,173,718 | B1 | 1/2001 | Okumoto et al. | |
| 6,223,753 | B1 | 5/2001 | Lo | |
| 6,257,248 | B1 * | 7/2001 | Yeh | 132/213 |
| 6,325,072 | B1 | 12/2001 | Smetana | |
| 6,494,216 | B1 | 12/2002 | Hirata | |
| 6,615,847 | B1 | 9/2003 | Hagelstam | |
| 6,622,735 | B2 | 9/2003 | Hirata et al. | |
| 2001/0022184 | A1 * | 9/2001 | Lee | 132/225 |
| 2002/0036000 | A1 | 3/2002 | Hirata et al. | |
| 2002/0190047 | A1 | 12/2002 | Nam | |
| 2003/0071027 | A1 * | 4/2003 | Lo | 219/225 |
| 2004/0003824 | A1 | 1/2004 | Habibi | |
| 2004/0163661 | A1 | 8/2004 | Carlucci | |

OTHER PUBLICATIONS

International Search Report for PCT Application No. PCT/US06/49565 issued by ISA/US on Oct. 26, 2007.

* cited by examiner

*Primary Examiner* — Rachel R Steitz
(74) *Attorney, Agent, or Firm* — Law Offices of Kumran Fattahi

(57) ABSTRACT

A new hair treatment device is provided for providing lift at the root portion of the hair near the scalp to thereby create volume and body to otherwise limp or flat hair. An embodiment of such a device includes first and second arms. A pivot movably joining the arms about the pivot is provided wherein each arm includes a hair-engaging surface. A heat source is provided for at least one of the hair-engaging surfaces. Each hair-engaging surface has a width suitable for treating a portion of the hair proximate the head, wherein by treating a portion of hair near the scalp, it provides lift and body to the head of hair. A method for adding lift to a head of hair using a hair crimping tool includes the steps of selecting hair from a head of hair for treatment; and using the tool to treat at least one portion of the selected hair proximate the roots of the hairs.

18 Claims, 5 Drawing Sheets

HAIR TREATMENT DEVICE

CROSS-REFERENCE TO RELATED APPLICATION(S)

This application claims the benefit of U.S. Provisional Application Ser. No. 60/755,580 filed on Dec. 30, 2005, which is incorporated herein by reference.

BACKGROUND OF THE INVENTION

1. Field of the Invention

This invention generally relates to hair treatment systems that are used to style people's hair as desired, and more specifically, relates to a hair treatment device and method that can be used to provide volume and body to the human hair.

2. Description of the Related Art

Currently there exist a number of different hair treatment devices and hair irons that are used to style/shape, straighten, or curl the hair, some of which also provide a steam function during the styling process. Examples of existing hair treatment devices have been disclosed in various patents, including U.S. Pat. Nos. 3,603,765; 5,934,293; 6,119,702; 6,173,718; 6,325,072; 6,494,216; 6,622,735; and U.S. published applications numbered 2002/0036000 (application Ser. No. 09/885,711), 2002/0190047 (Ser. No. 10/165,846), 2004/0003824 (Ser. No. 10/390,579), and 2004/0163661 (Ser. No. 10/686,497).

Existing hair irons and hair styling devices typically have a handle and a pair of arms joined by a pivot to enable the opening and closing of the arms, with each arm having a hair engaging surface that is flat or curved to conform to and join with the opposite surface. Such devices are typically powered by electricity and are provided with the capability to apply heat and/or steam to the hair engaging surfaces. In these existing devices, the portion of the human hair that is to be treated is placed between the opposite surfaces of the arms, and when the arms are closed, that portion of the hair is subjected to pressure (gripping force) and heat (and/or steam), and as the pair of engaging surfaces are slowly moved across the length of the hair, the portion of the hair placed between the engaging surfaces is straightened or styled in a particular shape as desired by the user or the stylist.

However, one drawback of the existing hair irons and hair styling devices is that while they allow the user to shape or straighten the hair from wavy to straight or from straight to wavy, they leave the hair limp or flat and cannot add a desired amount of volume to the hair. This is because adding volume to hair requires the hair to be "lifted" near its root portion such that the hair can maintain its lift for a relatively significant time (days or weeks), but existing hair styling devices are not designed to cause such lift in the root portion and instead are designed to style or shape the portion of the hair extended further away from the root.

In view of the foregoing, a hair treatment device and method is needed that is capable of causing the root portion of limp or flat hair to be lifted away from the scalp to create volume and body in the hair for an extended period of time (days or weeks). The present invention fulfills these and other needs.

SUMMARY OF THE INVENTION

A new hair treatment device is provided for providing lift at the root portion of the hair near the scalp to thereby create volume and body to otherwise limp or flat hair. An embodiment of such a device includes first and second arms. A pivot movably joins the arms about the pivot wherein each arm includes a hair-engaging surface. A heat source is provided for at least one of the hair engaging surfaces. Each hair-engaging surface has a width for treating a portion of the hair proximate the head, wherein by treating a portion of hair near the scalp, it provides lift and body to the head of hair.

A method for adding lift to a head of hair using a hair crimping tool includes the steps of providing a head of hair and selecting hair for treatment, and using the tool to treat at least one portion of the selected hair proximate to the roots of the hairs.

BRIEF DESCRIPTION OF THE DRAWINGS

Other aspects, advantages and novel features of the invention will become more apparent from the following detailed description of the invention when considered in conjunction with the accompanying drawings wherein.

DESCRIPTION OF PREFERRED EMBODIMENT(S)

A new hair treatment device and method is provided for providing lift at the root portion of the hair near the human scalp to thereby create volume and body to otherwise limp or flat hair.

Figure 1:
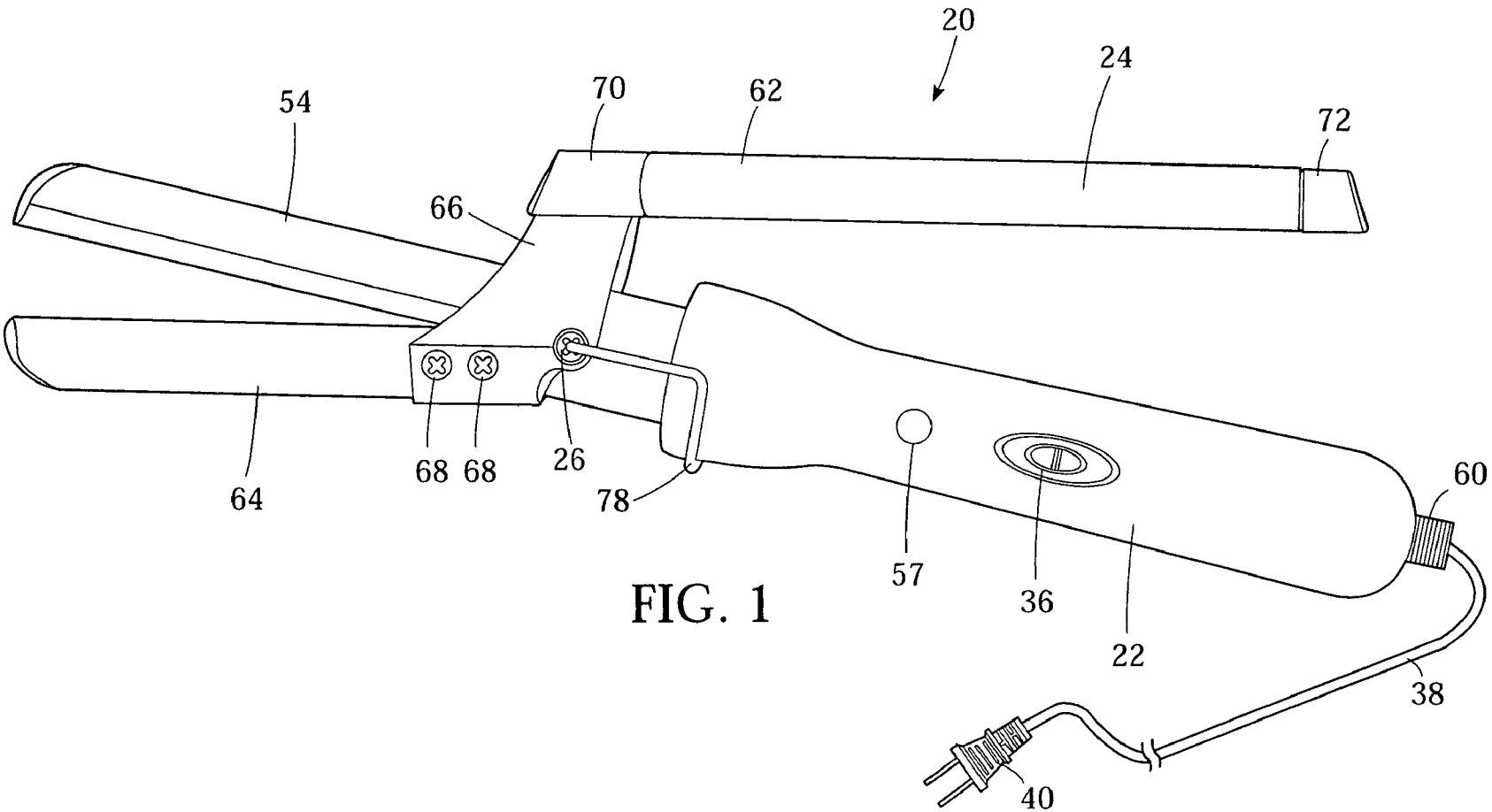
FIG. 1 is a perspective view of a device of the present invention.

As shown in exemplary FIG. 1, a device 20 of the present invention has a handle portion with a pair of arms 22 and 24 joined by a pivot 26 to enable the opening and closing of the arms 22 and 24, with each arm 22 and 24 having a hair engaging surface 28 and 30 (FIG. 2) that is heated through the use of electrically heated mechanisms 32 such as a heat induction coil type connected in circuit 34 through an optional on/off switch 36 and electrical cord 38 to an outlet plug 40 for receiving conventional household A/C power in a manner that is known to those skilled in the art.

Figure 3:
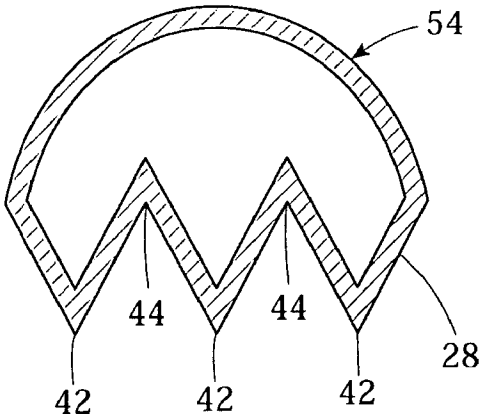
FIG. 3 is a cross-sectional cut-away view of a heat transmissive member taken along line 3-3 of FIG. 2.
Figure 4:
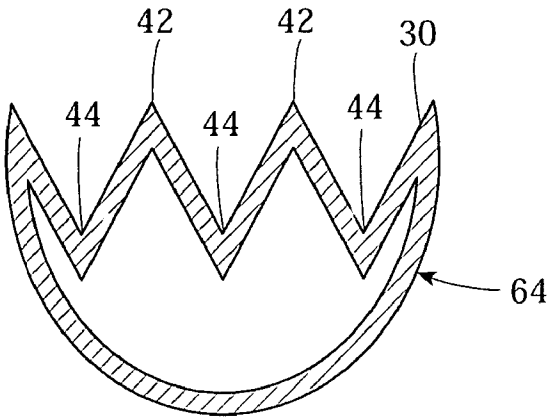
FIG. 4 is a cross-sectional cut-away view of a heat transmissive member taken along line 4-4 of FIG. 2.

With reference to FIGS. 3-4, widthwise cross-sections of complementary hair engaging surfaces 28 and 30 includes a series of sharp and angled peaks 42 and valleys 44, commonly referred as a saw tooth type pattern that extend uniformly along the length thereof such that the peaks and valleys in one engaging surface conform to and come together against the valleys and peaks, respectively, in the other engaging surface in a complementary engaging manner. Advantageously, the hair engaging surface width is narrow relative to the width of conventional hair engaging surfaces in use today to provide greater flexibility in engaging and working with a small portion of the hair fibers nearest the root. Considerations for a suitable widthwise measurement for the hair engaging surfaces should include engaging a small portion of hair near the root while engaging a sufficient amount to perform the method of the present invention. Other factors relevant to how well the roots of hair can be lifted for better volume include, but are not limited to:

(1) the width of the teeth of the heated surfaces;

(2) the depth of the teeth; and (3) the temperature of the heated surfaces.

Through experimentation it has been found that a preferred temperature range suitable for the heated surfaces is between 130 and 170 F where the lower temperatures would be suitable for fine hair, and the higher end of the temperature range would be better for thicker hair. It should be noted that other temperatures outside this range may be used with differing results and for different hair conditions. While not intended for purposes of limitation, a preferred widthwise measurement of the type suitable for this purpose is approximately 16 mm, wherein a tooth depth from valley to peak is approximately 4-5 mm and a tooth width from tip to tip is approximately 4-5 mm. It will be appreciated by those skilled in the art that when considering these parameters for the hair engaging surfaces, that other measurements and designs may be achieved without departing from the present invention.

Figure 2:
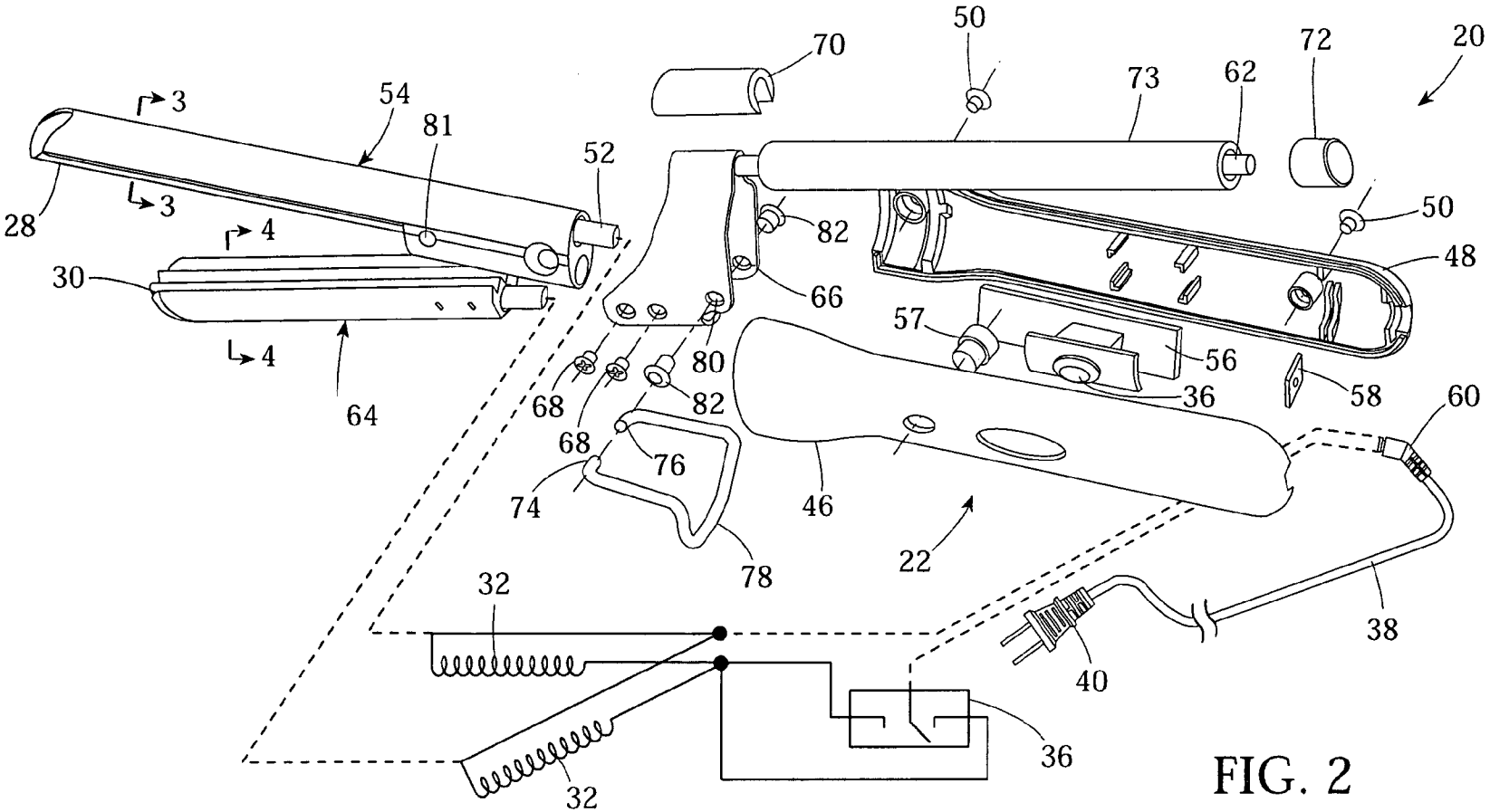
FIG. 2 is an exploded, perspective view of the device of FIG. 1.

With continued reference to FIGS. 1 and 2, the embodiment presently described is a hand tool, designed primarily for gripping objects by using leverage between the hair engaging surfaces 28 and 30 forming a jaw connected to the arms 22 and 24 via a pivot 26. Thus, an instrument is formed that converts a hand grip, the curling of the fingers into the palm of the hand, into a precision grip, which directs the power of the hand's grip in a precise fashion on the hair to be engaged. The arms are generally long relative to the shorter length of the hair engaging surfaces. Therefore, they act as levers, concentrating and, in effect, amplifying the force in the hand's grip on the hair.

A first arm 22 formed from complementary injection molded plastic halves 46 and 48 attached by a fastener 50 such as a screw or rivet, includes a hollow interior for housing the electrical circuit 34 and connects to a cylindrical portion 52 of a heat transmissive member 54 having a hair engaging surface 28 in a semi cylindrical portion and housing the heating mechanism 32 at one end and the electrical plug 40 via the power cord 38 at the opposite end. On models incorporating a power switch 36, a switch plate 56, covering the electrical switch 36 is included to insulate the user from the electrical circuit 34. The switch may include different setting for high and low temperatures. An optional display 57 such as an LED may be used to show different heat settings (e.g., low and high) as determined by the brightness or the color of the display. Furthermore, conventional electrical safety features as may be required country by country are included such as a cord anchor 58 to isolate the electrical circuit 34 from tugs on the cord 38 and an added cord insulator 60 at the entry of the cord 58 to the arm 22 to prevent over-bending of the cord. Other safety features may include a safety circuit breaker (not shown) included in the plug 40.

A second arm 24 formed from a metal rod 62 couples to a semi cylindrical heat transmissive member 64 having a hair-engaging surface 30 via a hinge member 66 that further couples to the heat transmissive member 54 of the first arm 22 at the pivot 26. Fasteners 68 such as screws connect the hinge member 66 to the heat transmissive member 64. The second arm 24 is coupled conventionally, such as formed integrally with the hinge member or via other conventional type fasteners such as a friction fit, or press fit, connection, thread coupling or soldering. Presently soldering is the preferred fastener for coupling the second arm 24 to the hinge member 66. Plastic guards 70 and 72 cover the opposing ends of the second arm and hold in place a plastic sleeve 73 covering the metal rod. The pivot is formed from opposing ends 74 and 76 of a looped metal rod 78 inserted through respective pivot apertures 80 and 81 in the hinge member and heat transmissive member connected to the first arm. Pivot collars 82 ensure a snug fit between the hinge member 66 and the metal rod ends 74 and 76. The metal rod 78 forms an oval loop bent at a right angle so as to function as a retractable stand for the device that holds the heat transmissive members above a resting surface. The hinge member 66 is formed as a C-shaped collar about the heat transmissive member of the first arm 22 and allows for attachment of the second arm 24 offset from the pivot 26 so as to increase the leverage of the arms 22 and 24 against the heat transmissive members 54 and 64. This arrangement allows for greater pressure to be brought against the complementary hair engaging surfaces 28 and 30. Flexibility in the second arm 24 ensures that the leveraged pressure is not so strong as to damage the hair fibers. Configured in this manner, the heat transmissive member 64 of the second arm 24 does not require a heating mechanism, but acquires heat from the heating mechanism 32 in the heat transmissive member 54 of the first arm 22 when the heat transmissive members 54 and 64 are brought into complementary contact to form a generally cylindrical shape. In the presently preferred embodiment, however, both heat transmissive members include heating mechanisms. Both heat transmissive members are optionally covered with fabric such as felt (not shown) on the non-hair engaging surfaces to insulate the user from the heat.

Figure 5:
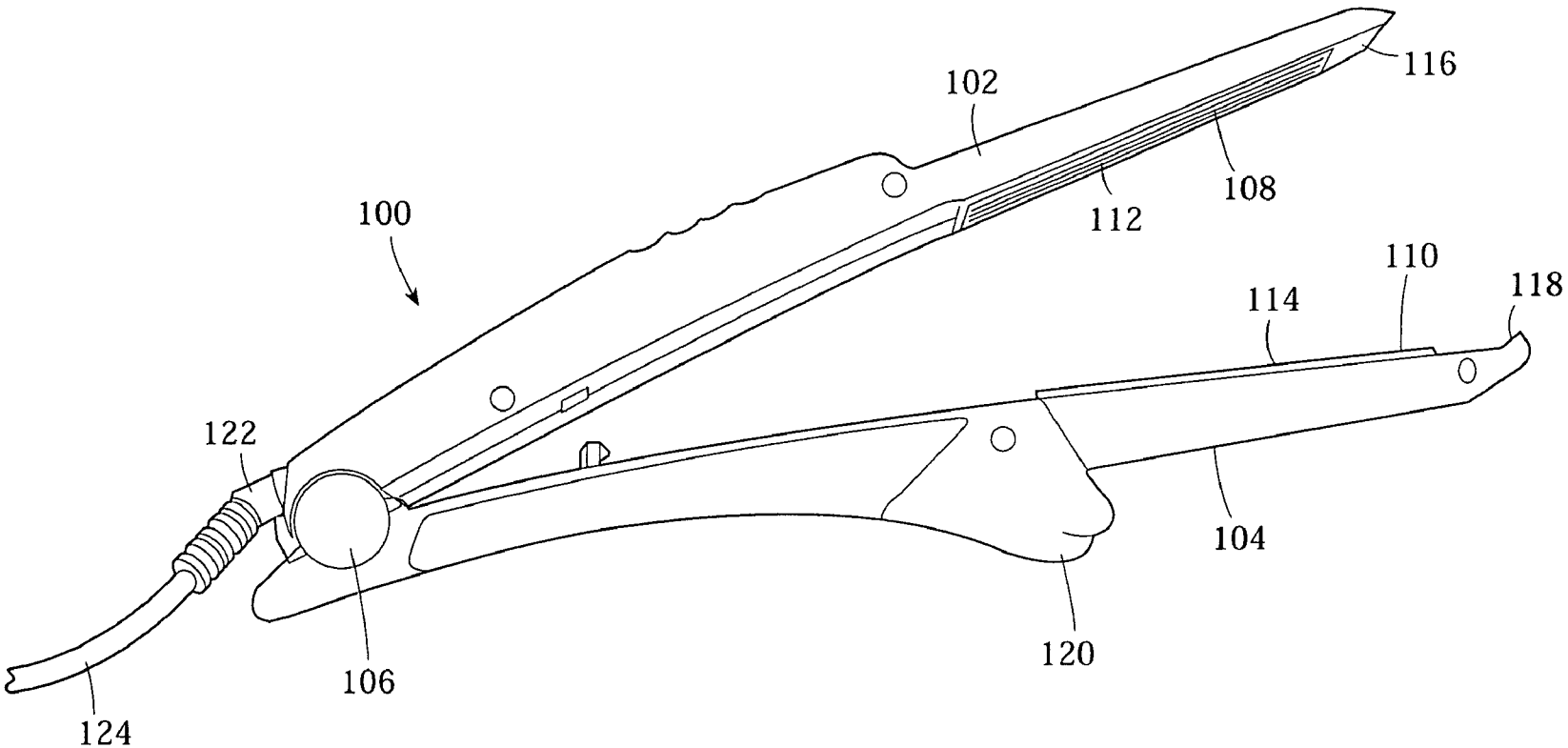
FIG. 5 is an alternate embodiment of the present invention.

With reference to FIG. 5, in another embodiment mostly intended for at home self-styling users, a device 100 includes a pair of conventional molded plastic arms 102 and 104 that are joined together at a pivot by a plastic pin 106. Heat transmissive members 108 and 110 are surrounded by the arms exposing only the complementary hair engaging surfaces 112 and 114. Lips 116 and 118 on the arms extend beyond the hair engaging surfaces to allow a solo user grasp the device at both the arms and the free end to provide sufficient tension to crimp the hair. The arms 102 and 104 insulate the user's hands from the heat transmissive members 108 and 110. The electrical circuit (not shown) as in the previous embodiment extends through only one arm to an electrical cord and utilizes a similar circuit to the circuit 34 of FIG. 2 also formed in the handle. A stand 120 to keep the heating elements off of a resting surface is formed integrally in one or both of the handles. Electrical safety features as required are included such as additional insulation 122 to resist over-bend of the cord 124.

In actual use of the present invention, the portions of the hair fibers that are desired to be imparted with "lift" are grabbed and placed between the engaging surfaces of the pair of arms, and the arms are manipulated by the user's hand to bring the engaging surfaces adjacent one another and into a closed position. The "lift" effect functions best when the selected portions are chosen as close to the root as possible without contacting the scalp of the user with the heat transmissive members. With the heat and locking pressure applied to the root portions of the hair that is sandwiched between the series of sharp peaks and valleys of the engaging surfaces, the root portions are forced to mold themselves into the series of sharp peaks and valleys along the length of the heated engaging surfaces, which in turn causes the root portions to retain a jagged or saw-tooth shape that lifts the root of the hair and causes it to stand up and away from the scalp. When this process is conducted in several segments of the hair, the resultant lifting of the root portions of the strands of hair that have been treated by this device creates volume and body to the entire hair, a result that can last days or weeks. Once the device of the invention is used to provide lift, volume and body to the hair, other existing hair irons or hair styling devices may be used in conventional fashion to style or shape the hair as desired.

Figure 6B:
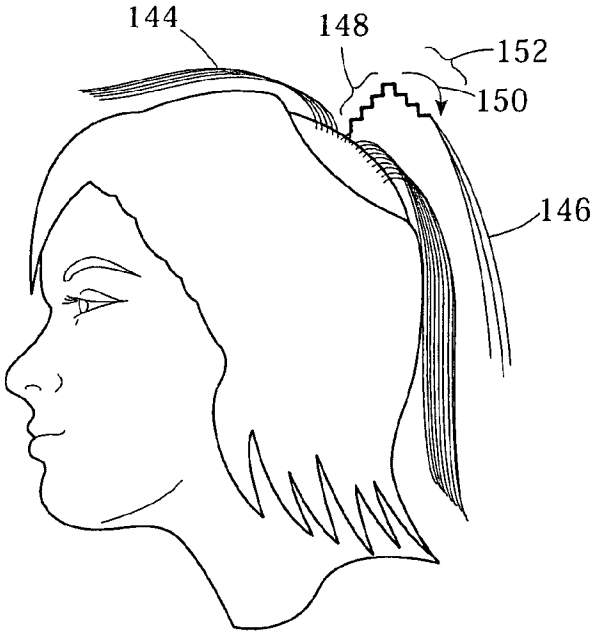
FIG. 6B is a portion of a human scalp with hair having a portion treated for providing lift.
Figure 6C:
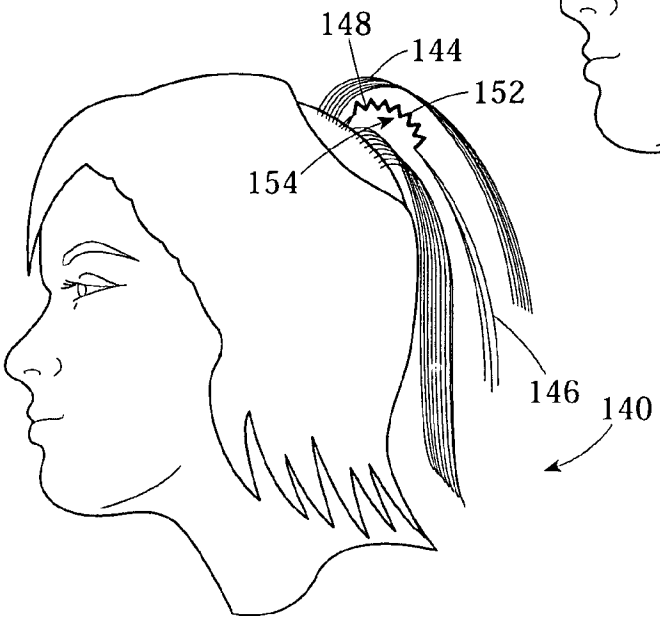
FIG. 6C is a portion of a human scalp with hair after having a portion treated for providing lift.
Figure 6A:
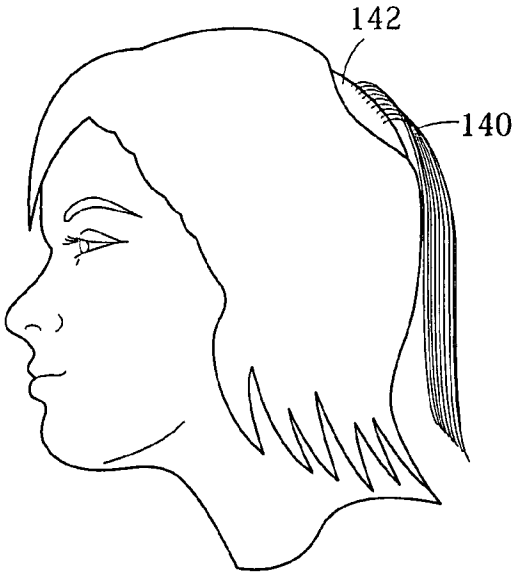
FIG. 6A is a portion of a human scalp with hair.

An example of the method of the present invention for providing lift is illustrated by FIGS. 6A-C. First, the hair is prepared by washing or drying the hair 140 and scalp 142 and the hair is generally groomed in the directions appropriate for the desired hairstyle. Then the upper layers of hair 144 are combed back to reveal underlying layers appropriate for providing lift. A tuft or portion of hair 146 is selected either by a comb or combing the hair with fingers. The device is then used to crimp a portion 148 of the selected hair 146 near the root. The tool should be located as close as possible without touching the scalp with the device. This process provides some lift and volume to the hair. To achieve even more volume the selected hair is rotated as shown by arrow 150 at approximately 90 degrees to the original crimped portion and a proximate portion 152 is crimped. The triangular region formed by the two crimped portions 148 and 152 formed by the crimping steps adds extra lift and volume as shown by arrow 154 of FIG. 6C. This process is then repeated as necessary to achieve the desired lift results. The overlying hair 144 is again combed over the crimped hair portions 148 and 152 to mask the lift treated portions from view. By this method, the head of hair is given extra lift volume and body. It should be noted that while a saw-tooth crimp is presently preferred with this method, other patterns may be used without departing from the present invention.

With the use of the present device, there is no longer any need to perform "back comb" of the hair to achieve similar results, and the knots and other damage to the hair that are created by back combing are avoided. The present invention also avoids (or reduces) the need to use gels, moose, or other solutions in order to give the hair volume and body, and the stickiness or matted feeling that is usually accompanied by such gels and solutions is avoided.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A device for adding lift to a head of hair comprising:

first and second arms;

a pivot movably joining said arms about a pivot;

each arm including a hair engaging surface;

a heat source for at least one of said hair engaging surfaces; and each hair engaging surface includes:

serrations that extend along a longitudinal axis of the hair engaging surface, with the serrations oriented parallel and set transversely along a width of the hair engaging surface;

the serrations include a series of sharp and angled peaks and valleys forming sharp vertices at the peaks and at the valleys, and extending uniformly along the longitudinal axis of the hair engaging surface, with the sharp peaks and valleys in a first engaging surface of the first arm conforming to and coming together against the sharp valleys and peaks, respectively, in a second engaging surface of the second arm in a complementary engaging manner;

wherein the serrations are adapted to engage substantially transverse a short span of a layer of tuft of hair proximal a scalp, near hair root to crimp hair into a sharply jagged, zigzag, non-undulating form near the scalp; and wherein each hair engaging surface width for treating a portion of said hair proximate the scalp is approximately 16 mm.

2. The device of claim 1 wherein said heat source includes an electrical heating mechanism connected in circuit to a power source.

3. The device of claim 2 wherein said circuit includes a switch.

4. The device of claim 1 wherein hair engaging surfaces are shaped in complementary patterns to crimp hair.

5. The device of claim 1 wherein hair-engaging surfaces are shaped in a series of complementary engaging peaks and valleys.

6. The device of claim 5 wherein hair-engaging surfaces are shaped as saw-tooth patterns for crimping hair.

7. The device of claim 1 wherein said pivot connects to said arms at a distal end away from said hair engaging surfaces.

8. The device of claim 7 wherein at least one arm is formed from molded plastic and includes a stand formed therein.

9. The device of claim 7 wherein each arm is formed from molded plastic and includes a heat transmissive member having said hair-engaging surface thereon.

10. The device of claim 9 wherein each said plastic arm covers all of said respective heat transmissive member except for the hair-engaging region.

11. The device of claim 10 wherein said plastic arm includes a lip on a free end proximate said hair engaging portion.

12. The device of claim 1, wherein said pivot connects to said arms to define a jaw created by said hair engaging surfaces and a hand grasp portion;

wherein at least one arm includes a plastic portion, a heat transmissive member and a hinge member connected to the plastic portion and the heat transmissive portion, said hinge member including a pivot aperture for receiving said pivot; and wherein said plastic portion connects to the hinge member offset from the pivot aperture to provide additional leverage to engage said portion of hair proximate the head.

13. The device of claim 12 wherein said pivot is formed by free ends of a rod shaped to function as a retractable stand.

14. The device of claim 12 wherein hair-engaging surfaces are shaped in a series of complementary engaging peaks and valleys and said series of complementary engaging peaks and valleys have a depth from valley to peak of approximately 4-5 mm.

15. The device of claim 12 wherein hair-engaging surfaces are shaped as saw-tooth patterns for crimping hair and each tooth has a width from peak to peak of approximately 4-5 mm.

16. A device for adding lift to a head of hair comprising:

first and second arms;

a pivot movably joining said arms about a pivot;

each arm including a hair engaging surface;

a heat source of approximately 130 to 170 F for at least one of said hair engaging surfaces; and each hair engaging surface has an approximate width of 16 mm, and includes:

serrations that extend along a longitudinal axis of the hair engaging surface, with the serrations oriented parallel and set transversely along a width of the hair engaging surface;

the serrations include a series of sharp and angled peaks and valleys, with a peak to peak span of approximately 4 to 5 mm, and valley depth of approximately 4 to 5 mm;

with the sharp and angled peaks and valleys forming sharp vertices at the peaks and at the valleys, and extending uniformly along the longitudinal axis of the hair engaging surface, with the sharp peaks and valleys in a first engaging surface of the first arm conforming to and coming together against the sharp valleys and peaks, respectively, in a second engaging surface of the second arm in a complementary engaging manner; and wherein serrations are adapted to engage substantially transverse a short span of layer of tuft of hair proximal a scalp, near hair root to crimp hair into a sharply jagged, zigzag, non-undulating form near the scalp for providing lift and body to the head of hair.

17. A method for adding lift to a head of hair using a hair crimping tool, comprising the steps of:

providing serrations that extend along a longitudinal axis of one or more hair engaging surfaces associated with the hair crimping tool;

heating the serrations;

engaging the serrations substantially transverse a short span of a selected lower layer of tuft of hair proximal a scalp, near hair root;

crimping selected hair in between the serrations into a sharply jagged, zigzag, non-undulating form near the scalp, forming a crimped portion;

covering the sharply jagged, zigzag, non-undulating formed lower layer of tuft of hair with an upper layer of tuft of hair so that the sharply jagged, zigzag, non-undulating formed lower layer of tuft of hair near the scalp is inconspicuous; and with the sharply jagged, zigzag, non-undulating formed lower layer of tuft of hair near the scalp providing resilience and lifting for both the lower and upper layers of tuft of hair away from scalp for increasing hair volume.

18. A method for adding lift to a head of hair using a hair crimping tool as set forth in claim 17, further comprising:

pivoting the serrations about the longitudinal axis;

reengaging the serrations at a second portion of the selected lower layer of tuft of hair that is adjacent and contiguous the crimped portion;

crimping the second portion of the selected hair adjacent a distal end of the crimped portion in between the serrations into a second sharply jagged, zigzag, non-undulating form, forming a second crimped portion; and covering the sharply jagged, zigzag, non-undulating formed lower layer of tuft of hair with an upper layer of tuft of hair so that the sharply jagged, zigzag, non-undulating formed lower layer of tuft of hair near the scalp is inconspicuous.

* * * * *